United States Patent [19]

Pachovsky

[11] Patent Number: 4,475,592

[45] Date of Patent: Oct. 9, 1984

[54] IN SITU RECOVERY PROCESS FOR HEAVY OIL SANDS

[75] Inventor: Roman A. Pachovsky, Calgary, Canada

[73] Assignee: Texaco Canada Inc., Calgary, Canada

[21] Appl. No.: 437,397

[22] Filed: Oct. 28, 1982

[51] Int. Cl.[3] ..... E21B 43/24

[52] U.S. Cl. ..... 166/272; 166/266

[58] Field of Search ..... 166/272, 266

[56] References Cited

U.S. PATENT DOCUMENTS

| | | | |
|---|---|---|---|
| 3,107,726 | 10/1963 | Greenwald | 166/266 |
| 3,131,741 | 5/1973 | Palmer | 166/272 |
| 3,881,550 | 5/1975 | Barry | 166/266 |
| 3,976,137 | 8/1976 | Bousaid | 166/272 |

*Primary Examiner*—Stephen J. Novosad
*Assistant Examiner*—Mark J. DelSignore
*Attorney, Agent, or Firm*—Robert A. Kulason; Robert Knox, Jr.; Albert Brent

[57] ABSTRACT

Bitumen is recovered from a subterranean formation of heavy oil sands traversed by at least one injection well and at least one associated production well in fluid communication with each injection well. Air in admixture with a heating fluid selected from the group consisting of low quality steam, hot water, or mixtures thereof, and an alkalinity agent are injected into the formation by way of each injection well. The subterranean heavy oil sands are thereby raised to a temperature in the range of about 200° to 350° F. A portion of the bitumen at reduced viscosity is oxidized without burning to produce additional petroleum acids which are neutralized to form emulsifying agents. The condensed steam and/or hot water contacting the bitumen form with it a bitumen-water emulsion. By pressure from the injected mixture of air and heating fluid, the resulting bitumen-water emulsion is then recovered from each production well. Demulsification takes place at the surface and bitumen, hot water, and sand are separated. Increased oil recovery efficiency may be obtained by pressure controlled cycles.

10 Claims, 2 Drawing Figures

RECOVERY OF BITUMEN
VS.
STEAM INJECTED

DISPLACEMENT EFFICIENCY
AT VARIOUS POSITIONS
IN ARC SIMULATION CELL

IN SITU RECOVERY PROCESS FOR HEAVY OIL SANDS

BACKGROUND OF THE INVENTION

This invention pertains to an in situ oil recovery method, and more specifically to a method for recovering bitumen from a subterranean formation of heavy oil sands.

Heavy oil sand, such as tar sand, deposits are located in the western portion of the United States; northern Alberta, Canada; Venezuela and in locations in Europe and Asia. For example, the Athabasca tar sand deposits in Alberta, Canada contain over 700 billion barrels of petroleum of a highly bituminous character.

The extremely high viscosity of the heavy oil from these sands, i.e. about 100,000 centipoises to over 1,000,000 centipoises at formation temperatures in the range of about 40°–125° F. makes impossible the recovery of bitumen by ordinary methods. However, the viscosity of the oil may be reduced to 10 centipoises or less by raising the temperature by several hundred degrees. The sand is generally a fine or medium grain predominantly quartz material. The individual grains are coated with a water, and enveloped with a bitumen film. Bituminous petroleum fills at least a portion of the void space between touching grains of sand. The sand grains are packed to a void volume of about 35%. This corresponds to a bitumen-sand mixture of roughly 83 wt. % sand.

Recovery of oil by a combination of low temperature oxidation and hot water or steam injection is disclosed in coassigned U.S. Pat. No. 3,976,137. The recovery of viscous oil using pressurization cycles is disclosed in coassigned U.S. Pat. No. 4,127,172. A thermal method for recovering oil employing steam injection and the introduction of a noncondensing gas which is substantially free of oxidizing components is disclosed in U.S. Pat. No. 3,782,470. Introducing an alkali solution into a formation of tar sand to create fractures and to leach and emulsify and the periodic reverse flush of the formation by passing a slug of alkaline solution through the production well is disclosed in U.S. Pat. No. 3,279,538. In situ recovery in which steam and a solvent are cyclically and continuously injected into tar sands is disclosed in U.S. Pat. No. 3,946,810.

While there are many proposed in situ methods for recovering heavy oil from heavy oil sands, there remains a need for an efficient and economical method such as provided herein for recovering viscous bituminous petroleum from subterranean deposts of heavy oil sands.

SUMMARY OF THE INVENTION

In the subject in situ bitumen recovery process, air in admixture with a heating fluid selected from the group consisting of low quality steam, hot water, and mixtures thereof and an alkalinity agent selected from the group consisting of sodium hydroxide, ammonium hydroxide, and ammonia are introduced into a formation traversed by at least one injection well and at least one production well. The heavy oil sand formation in and surrounding the communication path between the injection and production wells is thereby raised to a temperature of about 200° to 350° F. The heated bitumen in the heavy oil sand flows at a reduced viscosity, i.e. 10 centipoises or less. At least a portion of the bitumen oxidizes without burning to produce additional petroleum acids. These acids are then neutralized by the alkali present to produce emulsifying agents. The condensed steam and hot water contacting the bitumen forms a bitumen-water emulsion which is then forced through the communication path by pressure from the injected mixture of air and heating fluid and alkalinity agent. The bitumen-water emulsion is removed by way of an associated production well. Demulsification of the bitumen-water emulsion then takes place above ground and bitumen, hot water, and sand are separated. The efficiency of the process may be increased by operating with pressurization and drawdown cycles.

DETAILED DESCRIPTION OF THE PREFERRED EMBODIMENTS

Figure 2:
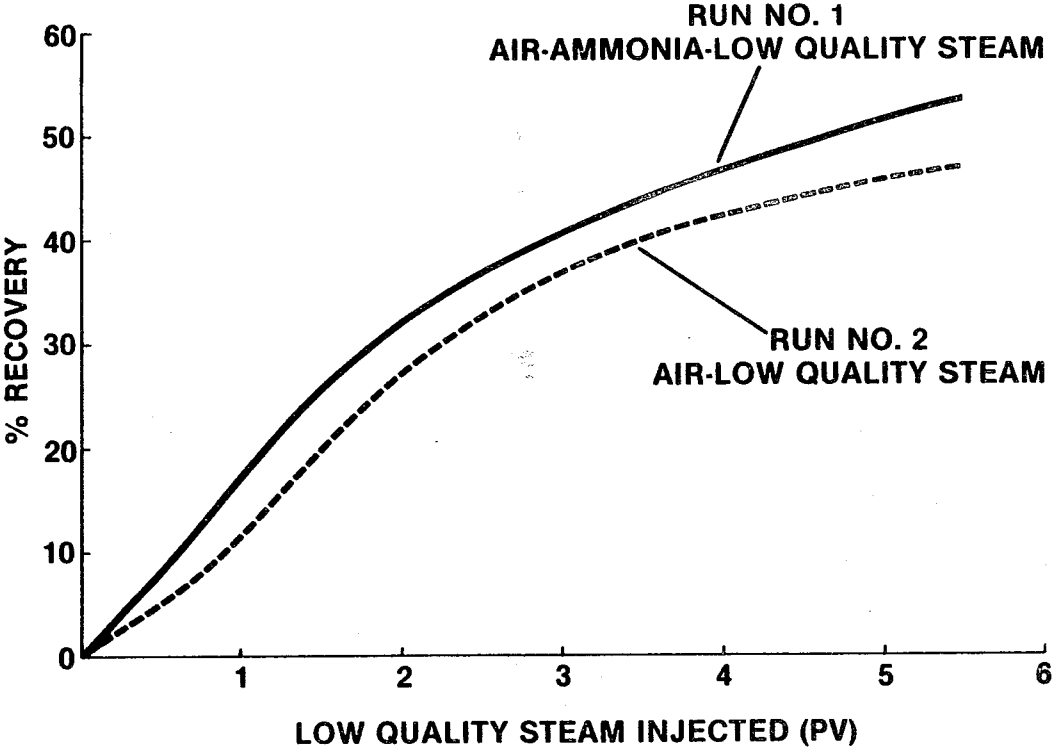
FIG. 2 illustrates % recovery of bitumen vs. steam injected (pore volume) for two runs. In the first run a mixture of air, low quality steam, and ammonia is injected into the sample of heavy oil sand; and for comparative purposes in the second run a mixture of air and low quality steam is injected.

Any suitable injection and production system may be used to carry out the subject invention. Thus, at least one injection well may extend preferably vertically from the surface of the earth into the subterranean formation of heavy oil sands. At least one associated production well may be located and spaced from each injection well in any desired pattern and also extend preferably vertically from the surface of the earth into the subterranean formation. For example, a line drive pattern may be utilized in which a plurality of injection wells in a row face a spaced horizontal row of associated production wells. In a circular drive pattern, a central injection well is surrounded by a concentric ring of production wells. Other patterns, including the 5 spot, 7 spot and 9 spot patterns are known to those skilled in the art. The injection and production wells are cased so that fluids may respectively enter and leave the communication path between the wells in the low portion of the formation, and preferably at the bottom thereof.

It is obviously necessary to have a good fluid communication path between the injection and production wells. When there are no naturally occuring horizontal fractures in the formation between the wells, or when the naturally occuring permeability of the heavy oil sands formation is not sufficient for the injection of steam and other fluids and the removal of the products at satisfactory rates, then, well known horizontal fracturing procedures may be employed. For example, such procedures as horizontal hydraulic fracturing, horizontal drilling, chemical explosive fracturing, injection of non-condensible gases and others may be used. For purposes of this invention, it will be assumed that an adequate communication path between each injection and associated production well has already been established.

In the subject invention, a mixture of air, and a heating fluid selected from the group consisting or low quality steam, hot water, and mixtures thereof and an alkalinity agent are injected into the fluid communication path between the injection and production wells. Preferably, the injection is accomplished at the maximum flow rate possible, consistent with the pressure limitations of the formation. The air provides the oxygen for oxidizing constituents in the bitumen to produce additional unsaturated polycyclic hydrocarbon acids. These petroleum acids are for example in the range of about $C_{16}$ to $C_{32}$ and have 1 to 3 attached carboxyl groups. This oxidation reaction takes place at low temperature without burning. The nitrogen in the air acts as a temperature moderator. The presence of the alkali catalyzes the oxidation reaction. At least one of the carboxyl groups reacts with the alkali to produce an emulsifying agent. Surprisingly, air was found to be more effective for this purpose than substantially pure oxygen. In a preferred embodiment, from about 0.05 to 0.3, such as about 0.10 to 0.20, thousand standard cubic feet (MSCF) of air is used in admixture with each barrel (bbl) of low quality steam (basis liquid water equivalent).

The wet steam may be supplied at a pressure in the range of about 200 to 350 pounds per square inch absolute (psia), such as 250 to 300 psia for an overburden depth of 300 feet. Higher steam temperature and pressure may be used when the overburden depths are greater. The static pressure in the formation, expressed in pounds per square inch absolute, should not exceed the overburden thickness expressed in feet. However, the injection pressure may go up to a thousand psia or more. The air may be supplied at a temperature in the range of about ambient to 440° F., such as about 60° to 300° F. The pressure of the wet steam and air mixture in the formation should be substantially below that which would produce vertical or surface fractures in the overburden.

From about 0.5 to 10, such as 1 to 5 wt. % (basis $H_2O$) of a suitable base may be mixed with the low quality steam and/or hot water heating fluid before or at the time they are mixed with air. The basic material will give the wet steam and/or hot water a pH of greater than 9, such as 10–12. For example, ammonia in the amount of about 3–5 wt. % or sodium hydroxide in the amount of about 0.5 to 1.0 wt. % may be mixed with the wet steam and/or hot water to form a stream of basic heating fluid which is then mixed with a stream of air. Alternatively, three separate streams comprising air, heating fluid, and alkalinity agent may be mixed together prior to injection into the formation. Although a variety of bases are effective in neutralizing the petroleum acids, the two most promising ones are ammonia (or ammonium hydroxide) and sodium hydroxide.

The portion of the subterranean heavy oil sands which is contacted by said mixture of air and basic heating fluid is raised to a temperature in the range of about 200° to 350° F., say about 100° to 300° F., such as about 125° to 225° F. The viscosity of the bitumen is reduced and in the presence of the emulsifying agent, the bitumen is stripped from the sand and combines with condensed steam and/or hot water to form the bitumen-water emulsion containing from about 5–40, such as 20 wt. % bitumen. The bitumen particles in the emulsion range in size from about 0.1 to 10 microns. Sufficient alkalinity agent is provided in the injection mixture to provide the bitumen-water emulsion with a pH in the range of greater than 9 to 12, such as 10.5.

The bitumen-water emulsion is displaced along the communication path and forced to the surface through the production well. The viscosity of the bitumen-water emulsion (20–30 wt. % bitumen) is essentially the same as that of water. The basic mixture of air and heating fluid drives the bitumen-water emulsion to the production well by the pressure differential between the wells.

Any conventional method may be used above ground for demulsifying the bitumen-water emulsion and separating the bitumen from water and sand. For example, the bitumen-water emulsion may be processed by settling to remove sand; dehydration, chemical, thermal or electrical treatment; filtration, centrifuging, and various combinations thereof. The separated bitumen serves as a raw material for the production of various petroleum products including heavy crude, asphalt, tar, solvents, gases, etc. The separated water stream is upgraded by conventional methods, heated, and recycled to the injection well as wet steam or hot water.

The subject process may be continued until the wt. % bitumen in the produced bitumen-water emulsion is substantially reduced. At that time a pressure-drawdown cycle may be started to increase the rate of production. However, the marked beneficial effects of pressure depletion cycles in moving the bitumen-water emulsion through and around the communications path and into the production well makes it desirable to incorporate this procedure early in the process. Further, periodic cleanout of the communication paths may be accomplished by pressurization and drawdown cycles. Another benefit of pressure depletion cycles is the flashing of hot water to steam in the formation. This results in the removal of water and bitumen from areas in the formation previously unaffected by the drive caused by pressure gradients from the injection to the production wells. Accordingly, a preferable embodiment of the subject process is to start the pressure-drawdown cycle soon after bitumen-water breakthrough occurs to the production well. While the following pressure-drawdown cycle is typical and preferred, variations in the pressure and flow rate changes may be made:

(a) gradually throttle the flow rate of the bitumen-water emulsion from each production well and simultaneously bring the formation pressure at each associated production well to a pressure in the range of about 60–90% of the injection pressure of the mixture of air, heating fluid, and alkalinity agent, thereby producing said bitumen-water emulsion at each associated production well;

(b) thereafter decrease the injection rate of the mixture of air, heating fluid and alkalinity agent to about 40 to 60% of the original injection rate at each injection well and simultaneously increase the production rate of the bitumen-water emulsion at each associated production well to a maximum safe rate; (Note: this effect causes a pressure depletion or drawdown to occur).

(c) continue the production of fluids from each production well and the introduction of the mixture of air, heating fluid and alkalinity agent at a reduced rate into each associated injection well until the flow rate of the bitumen-water emulsion drops to a value in the range of about 10–50% of the maximum safe rate in (b); and (d) thereafter cycle steps (a), (b) and (c) as long as the bitumen emulsion may be produced at an economically desirable flow rate.

EXAMPLES

Another embodiment of the invention is directed to a method for the recovery of bitumen from a subterranean formation of heavy oil sands traversed by at least one injection well and at least one production well associated with each injection well, and having a fluid communication path therebetween comprising:

(1) introducing into said formation by way of each injection well a mixture of air, low quality steam, and ammonia, wherein the ratio of air to low quality steam is in the range of about 0.05 to 0.3 thousand standard cubic feet of air per barrel of steam (basis water), raising said subterranean heavy oil sands to a temperature in the range of about 200° to 350° F. and reducing the viscosity of and oxidizing without burning a portion of the bitumen in said heavy oil sands to produce additional protroleum acids and neutralizing said petroleum acids; and combinining said bitumen with water to produce a bitumen-water emulsion having a pH of greater than 9, and recovering said bitumen-water emulsion by way of at least one production well;

(2) thereafter commence choking back the production well such that bitumen-water emulsion at the production well pressure is produced but not steam;

(3) stopping or sharply reducing the injection rate when the pressure at the production well reaches a substantial portion of the injection pressure, while simultaneously increasing the production rate of the bitumen-water emulsion;

(4) repeating (2) and (3) when the reservoir energy has been substantially depleted and the production rate of the bitumen-water emulsion has fallen to a low value; and (5) demulsifying the produced bitumen-water emulsion, and separating bitumen, water and sand.

The following examples illustrate a preferred embodiment of the process of this invention. The runs to be described below were performed in the Alberta Research Council's three-dimensional 18-inch simulator cell at conditions comparable to field operating conditions and within the ranges previously specified. By the results obtained, the operability of the process is clearly demonstrated.

The simulator comprises a vertical cylinder, 18 inches inside diameter and 16 inches high. Top and bottom horizontal end plates close off each end of the cylinder. A vertical piston is mounted below the top end plate and moves in a downward direction to apply a hydraulic pressure on the sample of oil sands packed below in the space between the bottom of the piston head and the bottom plate. This pressure simulates an actual overburden pressure of up to 1,000 psig. The sample of packed tar sand is 18 inches in diameter and about 10 to 11 inches high, depending on the precise location of the piston head. The sample is compressed by the vertical piston descending until the density and permeability of the tar-sand approximates that present in the subterranean formation. Two vertical ½-1 inch i.d. stand pipes, each spaced 3 inches from the cylinder wall along the diameter of the cylinder and 12 inches apart, extend upward through the bottom end plate and serve as the injection and production wells. A ⅛-inch thick by 2 inch wide by 12 inch long sand path between the injection and production wells simulates the communication path.

The cell in each run was packed with tar sand obtained from a mine at Fort McMurray in the Athabasca Region of Alberta, Canada. The cell was equipped for operating at controlled temperatures up to 420° F. and overburden pressures of 500 psig. The pressure of the low quality steam i.e., less than about 60%, was 300 psig.

In run 1, a mixture of air, low quality steam, and ammonia was injected into the oil sand pack. In run 2, ammonia was omitted from a mixture of air and low quality steam otherwise similar to that of run 1. When bitumen-water emulsion appeared in the production well the pressure draw down cycles, as previously described, were commenced. The duration of each run was 24 hours.

For comparative purposes, runs 1 and 2 were made under substantially the same operating conditions including tar-sand sample, length of test, injection pressure and temperature, and air/steam ratio.

Figure 1:
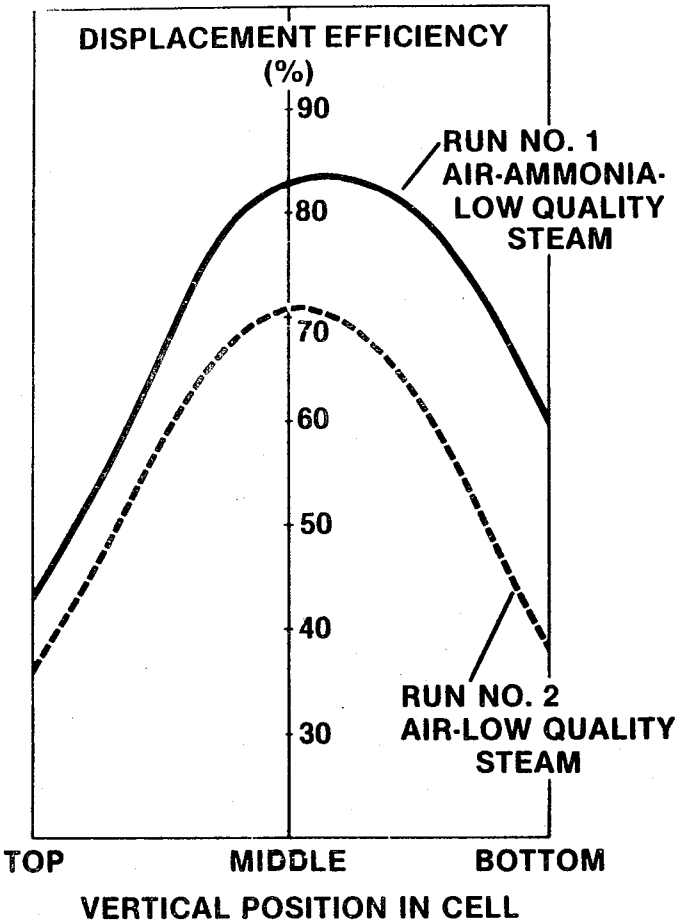
FIG. 1 illustrates the displacement efficiency at various positions in a simulation cell for two runs. In the first run a mixture of air, low quality steam, and ammonia is injected into the sample of heavy oil sand; and for comparative purposes in the second run a mixture of air and low quality steam is injected.

FIG. 1 is an analysis of the sandpack for bitumen depletion taken half-way between the injection and production wells at the end of the run. It is evident that the use of a base as provided in run 1, significantly improves the displacement efficiency everywhere in the cell. Further, improvement is most dramatic below the communication path (middle position in cell) where the formation of bitumen-water emulsions are favored by the water environment and promoted by the pressure draw down cycles.

FIG. 2 shows that throughout the period of the test, the % of bitumen recovered for a given cumulative pore volume (PV) of low quality steam injected is significantly higher in the presence of a base, as provided by run 1. By definition, pore volumes of low quality steam injected means pore volumes of water at 60° F. converted to low quality steam at the injected temperature and pressure.

The process of the invention has been described generally and by examples with reference to materials of particulate compositions for purposes of clarity and illustration only. It will be apparent to those skilled in the art from the foregoing that various modification of the process and materials disclosed herein can be made without departure from the spirit of the invention.

I claim:

1. A method for the recovery of bitumen from a subterranean formation of heavy oil sands traversed by at least one injection well and at least one production well associated with each injection well, and having a fluid communication path therebetween comprising:

(1) introducing into said formation by way of each injection well air in admixture with a heating fluid selected from the group consisting of low quality steam, hot water, or mixtures thereof, and an alkalinity agent; raising said subterranean heavy oil sands to a temperature in the range of about 200° to 350° F. and reducing the viscosity of and oxidizing without burning a portion of the bitumen in said heavy oil sands to produce additional petroleum acids and neutralizing said petroleum acids to produce emulsifying agents in said underground formation; and combining said bitumen with water to produce a bitumen-water emulsion;

(2) recovering said bitumen-water emulsion from said underground formation by way of at least one production well; and (3) demulsifying said bitumen-water emulsion and separating bitumen, water, and sand.

2. A method for the recovery of bitumen from a subterranean formation of heavy oil sands traversed by at least one injection well and at least one production well associated with each injection well, and having a fluid communication path therebetween comprising:

(1) introducing into said formation by way of each injection well air in admixture with a heating fluid selected from the group consisting of low quality steam, hot water, or mixtures thereof, and an alkalinity agent; raising said subterranean heavy oil sands to a temperature in the range of about 200° to 350° F. and reducing the viscosity of and oxidizing without burning a portion of the bitumen in said heavy oil sands to produce additional petroleum acids and neutralizing said petroleum acids to produce emulsifying agents in said underground formation; and combining said bitumen with water to produce a bitumen-water emulsion;

(2) recovering said bitumen-water emulsion from said underground formation by way of at least one production well; and after production of said bitumen-water emulsion is established:

(a) throttling the flow rate of said bitumen-water emulsion from each production well and simultaneously bringing the formation pressure at each associated production well to a pressure in the range of about 60–90% of the injection pressure of the mixture of air, heating fluid, and alkalinity agent, and producing said bitumen-water emulsion at each associated production well;

(b) decreasing the injection rate to about 40 to 60% of the original injection rate of the mixture of air, heating fluid and alkalinity agent at each injection well and simultaneously increasing the production rate of the bitumen-water emulsion at each associated production well to a maximum safe rate;

(c) continuing production of fluids from each production well and the introduction of the mixture of air, heating fluid and alkalinity agent at a reduced rate into each associated injection well until the flow rate of the bitumen-water emulsion drops to a value in the range of about 10–50% of the maximum safe rate in (b); and (d) thereafter cycling steps (a), (b) and (c) as long as the bitumen emulsion may be produced at an economically desirable flow rate; and (3) demulsifying said bitumen-water emulsion and separating bitumen, water, and sand.

3. The process of claim 1 wherein the quality of said steam is in the range of about 40 to 60.

4. The process of claim 1 wherein said alkalinity agent is selected from the group consisting of NaOH, $NH_4OH$, and $NH_3$.

5. The process of claim 1 wherein the ratio of air to low quality steam is in the range of about 0.05 to 0.3 thousand standard cubic feet of air per barrel of steam (as water).

6. The process of claim 1 wherein the weight ratio of bitumen to water in said bitumen-water emulsion is in the range of about 0.05 to 0.4.

7. The process of claim 1 wherein said low quality steam has a temperature in the range of about 250° to 420° F.

8. The process of claim 1 provided with the additional steps of upgrading the water from (3) and recycling said water to (1) as said heating fluid after being reheated or converted into low quality steam.

9. The process of claim 1 wherein the pH of the bitumen-water emulsion is greater than 9.

10. A method for the recovery of bitumen from a subterranean formation of heavy oil sands traversed by at least one injection well and at least one production well associated with each injection well, and having a fluid communication path therebetween comprising:

(1) introducing into said formation by way of each injection well mixture of air, low quality steam, and ammonia, wherein the ratio of air to low quality steam is in the range of about 0.05 to 0.3 thousand standard cubic feet of air per barrel of steam (basis water), raising said subterranean heavy oil sands to a temperature in the range of about 200° to 350° F. and reducing the viscosity of and oxidizing without burning a portion of the bitumen in said heavy oil sands to produce additional petroleum acids and neutralizing said petroleum acids; and combining said bitumen with water to produce a bitumen-water emulsion having a pH of greater than 9, and recovering said bitumen-water emulsion by way of at least one production well;

(2) thereafter commence choking back the production well such that bitumen-water emulsion at the production well pressure is produced but not steam;

(3) stopping or sharply reducing the injection rate when the pressure at the production well reaches a substantial portion of the injection pressure, while simultaneously increasing the production rate of the bitumen-water emulsion;

(4) repeating (2) and (3) when the reservoir energy has been substantially depleted and the production rate of the bitumen-water emulsion has fallen to a low value; and (5) demulsifying the produced bitumen-water emulsion, and separating bitumen, water and sand.

* * * * *